US005232500A

United States Patent [19]

Kamaji et al.

[11] Patent Number: 5,232,500

[45] Date of Patent: Aug. 3, 1993

[54] ONE-COMPONENT DEVELOPING APPARATUS HAVING A DEVELOPER LAYER THICKNESS REGULATING MEMBER WITH AN EDGE MACHINED ALONG A DIRECTION PARALLEL TO THE SURFACE OF A DEVELOPER HOLDER MEMBER

[75] Inventors: Hideki Kamaji; Kazunori Hirose; Masae Ikeda; Teturou Nakashima; Yukio Nishio, all of Kawasaki, Japan

[73] Assignee: Fujitsu Limited, Kawasaki, Japan

[21] Appl. No.: 933,910

[22] Filed: Aug. 27, 1992

Related U.S. Application Data

[63] Continuation of Ser. No. 748,950, Aug. 20, 1991, abandoned.

[30] Foreign Application Priority Data

Aug. 20, 1990 [JP] Japan ..... 2-219439

[51] Int. Cl.[5] ..... G03G 15/10

[52] U.S. Cl. ..... 118/261; 355/259

[58] Field of Search ..... 355/259, 251, 253; 118/261, 413

[56] References Cited

U.S. PATENT DOCUMENTS 4,431,296 2/1984 Haneda et al. ..... 118/654 X
4,981,726 1/1991 Rantanen et al. ..... 118/691 X

FOREIGN PATENT DOCUMENTS 63-85654 4/1988 Japan .
63-172291 7/1988 Japan .
2-259786 10/1990 Japan .

*Primary Examiner*—Richard L. Moses
*Attorney, Agent, or Firm*—Staas & Halsey

[57] ABSTRACT

A one-component developing apparatus includes a developing roller which holds a one-component developer and feeds the developer to a photosensitive drum, and a developer layer thickness regulating blade. The regulating blade has an edge which is parallel with a surface of the developing roller and the edge regulates the thickness of the developer layer on the drum. The edge is constructed by being machined along a direction in parallel with the surface of the developer roller. The edge of the regulating blade may be either sharp or rounded.

8 Claims, 9 Drawing Sheets

ONE-COMPONENT DEVELOPING APPARATUS HAVING A DEVELOPER LAYER THICKNESS REGULATING MEMBER WITH AN EDGE MACHINED ALONG A DIRECTION PARALLEL TO THE SURFACE OF A DEVELOPER HOLDER MEMBER

This application is a continuation, of application Ser. No. 07/748,950, filed Aug. 20, 1991, now abandoned.

BACKGROUND OF THE INVENTION

1. Field of the Invention

The present invention relates to a developing apparatus using a one-component developer and particularly to a one-component developing apparatus which includes a developer layer thickness regulating member for regulating the layer thickness of the one-component developer to be carried toward a latent image bearing member by a developer bearing member.

2. Description of the Related Art

In an image forming apparatus such as a copying apparatus, printer, etc., an electrophotographic system or an electrostatic recording system has widely been used as a recording system.

An image forming apparatus of such an electrophotographic system or an electrostatic recording system is provided with a developing apparatus which develops a latent image formed on a latent image bearing member such as a photosensitive material drum or dielectric material drum.

A one-component developing apparatus holds a one-component toner at its surface. The one-component developing apparatus includes at least a developing roller for transferring the toner and a layer thickness regulating blade which regulates the layer thickness of the one-component toner carried at the surface of the developing roller to a constant predetermined layer thickness. A latent image on the latent image bearing member is regulated in layer thickness by the layer thickness regulating blade and is developed by the one-component toner carried by the developing roller. The one-component toner is charged by a friction charge generated between the developing roller and the one-component toner or by a charge supplied from the blade which is connected with a power supply. Therefore, the developing operation can be carried out by adhering the toner on the latent image bearing member with electrostatic force being applied between the charged one-component toner and the latent image on the latent image bearing member.

In a one-component developing method using a one-component toner, the layer thickness (circumferencial direction and/or axial direction of the developing roller) of the one component toner carried by the developing roller has a substantial influence on the quality of image developed. The layer thickness of this one-component toner changes depending on the surface accuracy at a thickness-regulated surface of the layer thickness regulating blade, thus creating a problem. Namely, if the thickness regulating edge of the layer thickness regulating blade is formed with any unevenness, a vertical line appears on the developed image corresponding to such unevenness.

SUMMARY OF THE INVENTION

It is therefore an object of the present invention to provide a developing apparatus using a one-component developer which does not generate any vertical lines on the developed image.

It is another object of the present invention to provide a one-component developing apparatus having a layer thickness regulating blade which does not cause unevenness at the layer thickness regulating surface of the layer thickness regulating blade.

Additional objects and advantages of the present invention will be set forth in the description which follows, and, in part, will be clear from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention as embodied and broadly described herein, there is provided a developing apparatus using a one-component developer to develop a latent image on an image bearing member comprising: a developer holding member having a surface to hold the one-component developer, the surface of the developer holding member being disposed near the image bearing member in parallel with a surface of the image bearing member and supplying the one-component developer to the image bearing member to develop the latent image on the image bearing member; and a developer layer regulating member having an edge to regulate the thickness of layer of the one-component developer on the surface of the developer holding member, the edge of the developer layer regulating member being disposed in parallel with the surface of the developer holding member, and the edge of the developer layer regulating member is machined or processed along a direction in parallel with the edge of the developer holding member.

BRIEF DESCRIPTION OF THE DRAWINGS

The accompanying drawings, which are incorporated in and constitute a part of the specification, illustrate embodiments of the invention and, together with the description, serve to explain in the principles of the invention. In the drawings, like numerals refer to like parts throughout.

DETAILED DESCRIPTION OF THE PREFERRED EMBODIMENTS

Reference will now be made in detail to the present preferred embodiments of the invention, examples of which are illustrated in the accompanying drawings.

Figure 1:
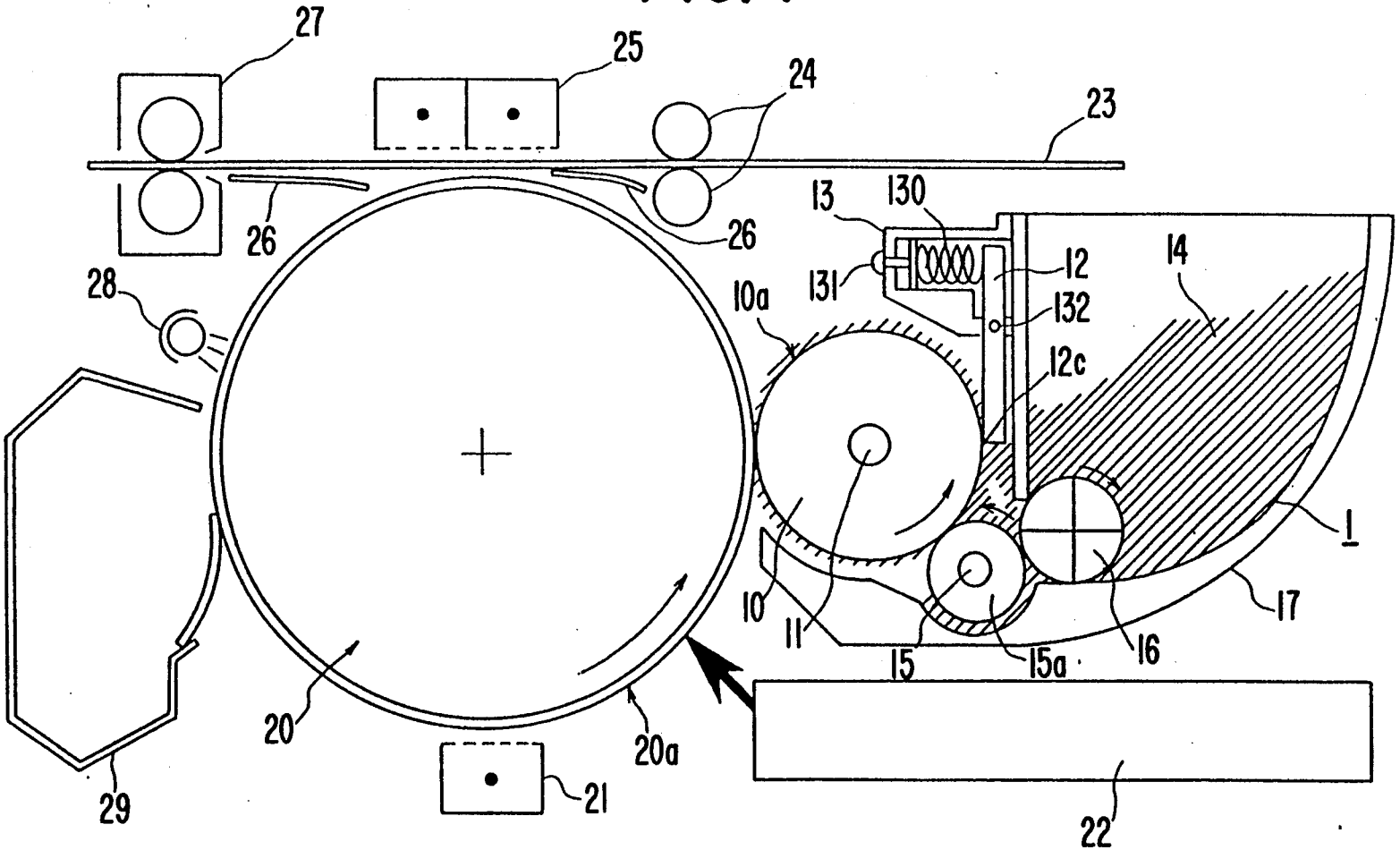
FIG. 1 is a schematic diagram of an image forming apparatus having a developing apparatus using the present invention.

FIG. 1 is a schematic diagram indicating an embodiment of an image forming apparatus having a developing apparatus using the present invention. The image forming apparatus shown in FIG. 1 is an electrophotographic printer.

In FIG. 1, a latent image bearing member 20 carries a latent image formed on the surface thereof to a developing section and also carries a developed image to a transfer position. The latent image bearing member 20 may comprise a photosensitive drum made of an organic photosensitive material, a selenium photosensitive material, an amorphous silicon photosensitive material, or the like.

A precharger 21 precharges a latent image bearing member (hereinafter a photosensitive drum will be explained as an example). A latent image writing unit 22 in the form of a laser scanning optical system, an LED array exposure optical system, or the like may be used to form a latent image on the photosensitive drum 20 through irradiation of light to the photosensitive drum 20 in accordance with an image to be recorded. A developed image on the photosensitive drum 20 is transferred to a recording sheet 23.

Feed rollers 24 feed the recording sheet 23 between a transfer charger 25 and the photosensitive drum 20. The transfer charger 25 transfers the developed image on the photosensitive drum 20 to the recording sheet 23. A sheet guide 26 is provided for guiding the recording sheet 23, which is transferred to a thermal fixing unit 27 after the developed image is transferred by the transfer charger 25. The thermal fixing unit 27 thermally fixes a toner image which is the developed image on the recording sheet 23. A discharging lamp 28 is used for deleting the electrical charge pattern on the photosensitive drum 20. A blade cleaner 29 is used for mechanically eliminating the toner remaining on the photosensitive drum 20.

A developing roller 10 is disposed so that a rotating conductive metal shaft 11 is parallel to a rotating shaft of the photosensitive drum 20. Therefore, the surface 20*a* of the photosensitive drum 20 and the surface 10*a* of the developing roller 10 are also parallel. The developing roller 10 rotates around the rotating shaft 11 to transfer and supply a one-component developer 14 to the photosensitive drum 20. The developing roller 10 transfers the one-component developer 14 held on the surface 10*a* to a developing position, where the developing roller 10 is in contact with the photosensitive drum 20, from a layer thickness regulating position by means of a layer thickness regulating blade 12. The one-component developer 14 on the surface 10*a* of developing roller 10 is attracted only to the image portion on the photosensitive drum 20 by an electrostatic force which is applied between the developing roller 10 and the photosensitive drum 20. Thereby, a latent image on the photosensitive drum 20 is developed.

The rotating shaft 11 performs the function of an electrode in that it applies a voltage to the conductive developing roller 10 so that forward and backward voltages are generated in the image portion and background portion of latent image between the developing roller 10 and the photosensitive drum 20.

For example, when an organic photosensitive material is used as the photosensitive material of the photosensitive drum 20, the voltage of the image portion is set to about −100 V and the voltage of the background portion is set to about −600 V. A voltage of −250 V is applied to the developing roller 10 through a power supply (not illustrated) and the rotating shaft 11. The layer thickness regulating blade 12 regulates the thickness of the developer on the rotating developing roller 10 with the thickness regulating edge 12*c* and is positioned so that the edge is parallel to the rotating shaft 11 of developing roller 10 and therefore is parallel to the surface 10*a* of developing roller 10. The layer thickness regulating edge 12*c* is formed by the intersection of surface 12*a* of the thickness regulating blade 12 provided opposed to the developing roller 10 and the surface 12*b* of the thickness regulating blade 12 in front of the rotating direction of the developing roller 10. The surfaces 12*a*, 12*b*, respectively, are processed by selecting the cutting or grinding direction so that the projecting and recessed areas are perpendicular to the directions of tangent and normal to the developing roller 10.

The thickness regulating edge 12*c* regulates the thickness of the one-component developer 12 to keep the thickness at a constant value and charges the one-component developer 14 with friction charges. The one-component developer 14 is charged by supplying the power from the thickness regulating blade 12 connected to a voltage power supply.

A holding member 13 rotatably mounts the thickness regulating blade 12 around a rotating shaft 132. A pressure applying means 130 consisting of a coil spring applies pressure to thickness regulating blade 12 on the end opposite of the end containing edge 12*c* in order to push the edge 12*c* of the layer thickness regulating blade 12 toward the surface of developing roller 10 with a constant pressure.

Such a construction permits the application of pressure to the thickness regulating blade 12 for regulating the thickness of the developer on the developing roller 10 to a predetermined constant thickness by the edge 12*c* of the thickness regulating blade 12 and for charging the developer 14 with friction charges.

Moreover, even when the developing roller 14 eccentrically rotates and the thickness regulating unit position changes, a pressure is applied to the thickness regulating blade 12 by the spring 130 so that the contact pressure of the thickness regulating blade 12 is always constant.

Moreover, the pressure of the spring 130 can be set to a different value by changing the setting of a pressure adjusting means 131 consisting of a screw having a plate at the edge thereof to change the holding position at one end of the spring 130.

A reset roller 15 collects developer 14 from the developing roller 10 after a latent image has been developed and also serves an auxiliary function of making uniform the thickness of the developer 14 remaining on the developing roller 10 by supplying the developer 14 within the developing unit to the developing roller 10.

A conductive metal rotating shaft 15*a* of the reset roller 15 applies a voltage to the reset roller which is made of conductive sponge while also rotating the reset roller 15. A voltage of −250 V, which is equal to the voltage applied to the developing roller 10, is also applied to the rotating shaft 15*a* of the reset roller 15.

A developer supplying means 16 is formed as a water-wheel type rotating body for supplying the developer 14 to the side of developing roller 10 from a developer case 17. The developer case 17 is used for storing the developer 14 to be supplied to the developing roller 10.

A polyester group nonmagnetic one-component developer having an average grain size of 12 micron may be used as the developer.

Figure 2A:
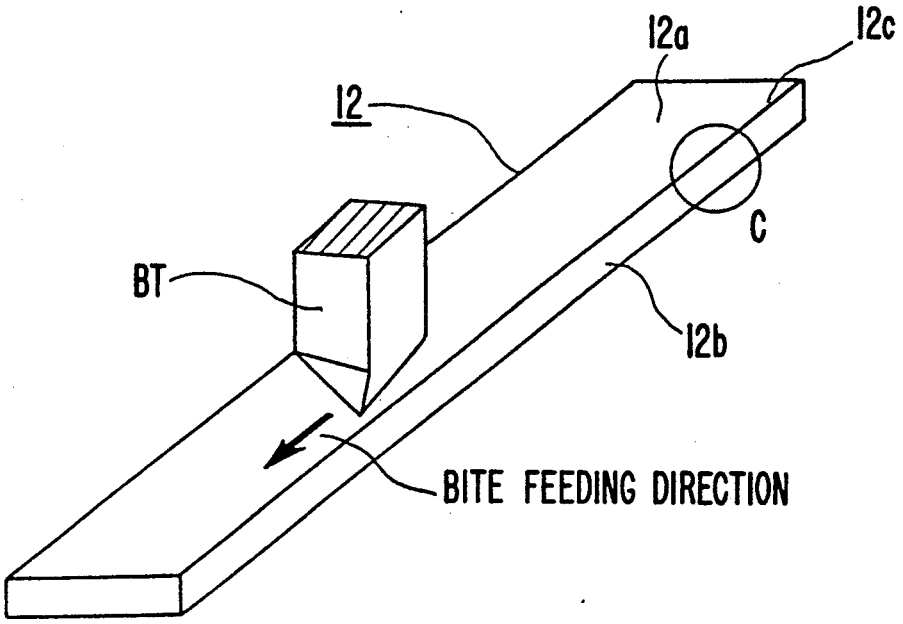
FIG. 2A is a perspective view illustrating an embodiment of the present invention.

As shown in FIG. 2A, when processing the surface 12*a* of the thickness regulating blade 12 on the side of developing roller 10 and the surface 12*b* thereof on the side where the developing roller 10 advances in order to obtain a straightness of 0.03 mm, the direction of cutter BT is set perpendicular to the tangent and normal directions of the developing roller 10.

Figure 2B:
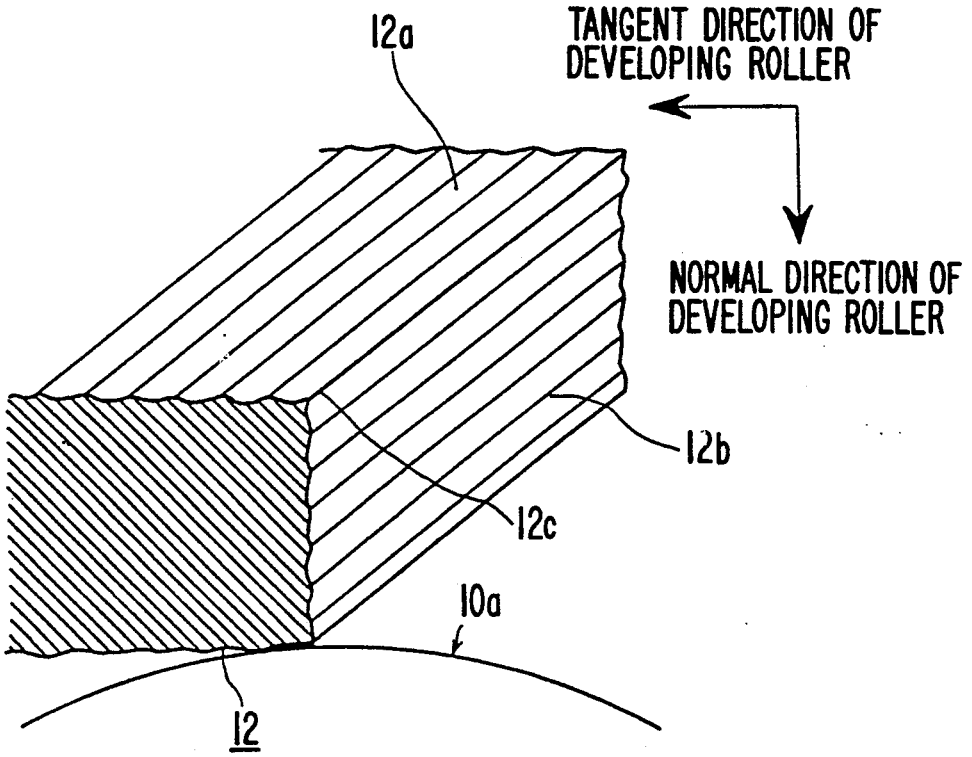
FIG. 2B is a perspective view of an enlarged portion C of the blade shown in FIG. 2A.

As a result a blade 12 having the edge 12*c* as shown in FIG. 2B is obtained.

Figure 3A:
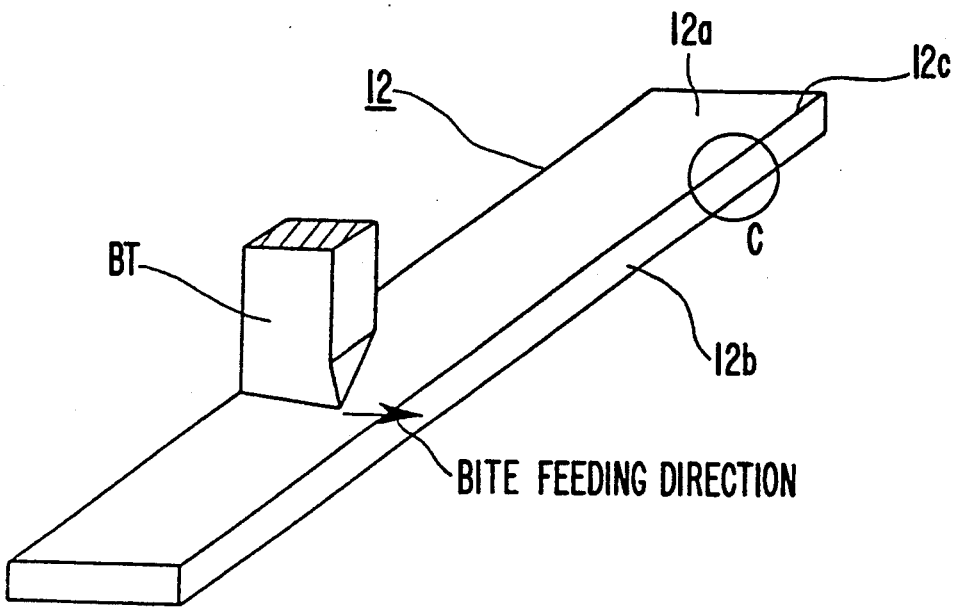
FIG. 3A is a perspective view illustrating a sample for comparison with the embodiment of the present invention shown in FIGS. 2A and 2B.
Figure 3B:
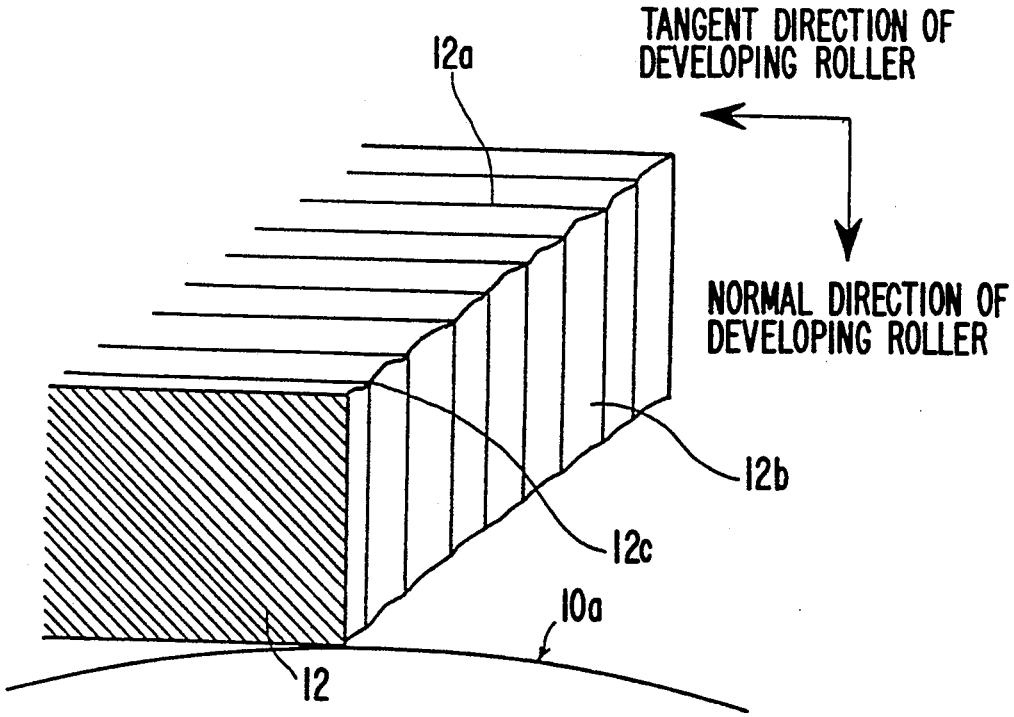
FIG. 3B is a perspective view of an enlarged portion C of the blade shown in FIG. 3A.

In order to compare the favorable results obtained by the embodiment of FIGS. 2A and 2B, a thickness regulating blade 12 is illustrated in FIGS. 3A and 3B wherein the surfaces 12*a*, 12*b* of the thickness regulating blade 12 are machined by setting the cutter BT feeding direction so that the surface 12*a* on the side of developing roller 10 is set along the tangent direction of the developing roller 10 and the surface 12*b* on the side where the developing roller 10 progresses is set along the normal direction of the developing roller 10. As a result, as shown in FIG. 3B, a blade having unevenness at the edge 12*c* is formed.

For the developing roller 10, an elastic rubber roller or a porous polymer formed urethane roller may be used. These two materials do not have unevenness at the surface thereof.

The hardness of an elastic rubber roller should be 30°, 40° and 50° in terms of JIS A hardness and the hardness of a porous polymer formed urethane roller should be 18°, 24°, 28°, 32° and 36° in terms of Ascar C hardness.

A molded plate of a conductive polyester group resin which intrinsically has less unevenness may be used as a material of the thickness regulating blade 12.

Printing was conducted with the apparatus shown in FIG. 1 using both the embodiment of the blade of the present invention shown in FIGS. 2A and 3B and the blade shown in FIGS. 3A and 3B in order to compare the results. Thus irregularities of density have been compared in order to confirm the effect of the present invention.

For the printing, screw 131 was adjusted to such pressure that the density of solid black printing of 4 mm square becomes 1.4 in terms of the refle- optical density O.D.

The printing referred to above means the printing executed by drawing a 1-dot lateral line with an interval of 1-dot. The solid black printing of 4 mm square was made in many numbers with formation of an interval of 20 mm in the lateral direction and an interval of 4 mm in the vertical direction.

In the case where a thickness regulating blade 12 shown in FIG. 3B was used, vertical (parallel to the moving direction of photosensitive drum 20) black and white lines which result in difference of optical reflex density O.D exceeding 0.14 in the printing of lateral line were observed regardless of which type of developing roller was employed.

The vertical lines were particularly distinctive in the image where dots were printed like a net or oblique lines were continuously printed and when a figure utilizing such images was printed, the printing quality was unsatisfactory.

Moreover, the thickness regulating blade 12 was removed from the developing apparatus 1 and unevenness of the edge 12*c* perpendicular to the tangent and normal directions of the developing roller 10 was examined using a surface roughness gage provided with a knife edge probe.

As a result, it was confirmed that the white lines and black lines generated in the printing and image, corresponded to the position of the edge 12*c* where large unevenness existed. The unevenness reached a maximum of 10 μm and the majority of such unevenness was about 5 μm.

Where the thickness regulating blade 12 of the present invention shown in FIG. 2B was used, however, only white and black lines with a difference of O. D. of 0.04 or less were generated and satisfactory printing was realized regardless of which type of developing roller was used.

A similar search for unevenness of the edge 12*c* of the thickness regulating member 12 conducted by removing the developing roller 10 proved that large unevenness was not generated, in comparison with the edge 12*c* of blade 12 shown in FIG. 3B. With the blade of FIGS. 2A and 2B, the unevenness reached a maximum of 5 μm and the majority of such unevenness was about 2~3 μm.

As explained above, it was proved that since unevenness of edge 12*c* can be reduced by setting the cutting direction of the thickness regulating blade 12 to the direction perpendicular to the tangent and normal directions of the developing roller 10 (parallel to the edge 12*c*), the thickness of developer 14 can be regulated to a uniform value.

Moreover, from the point of view of the printing quality, excellent printing was realized, without generating white and black lines.

Figure 4A:
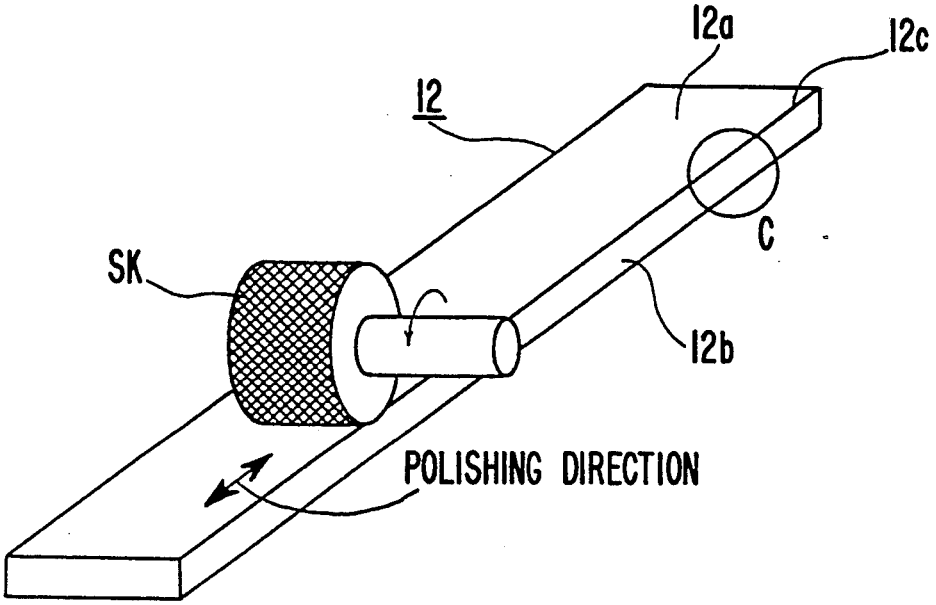
FIG. 4A is a perspective view illustrating another embodiment of the present invention.

FIG. 4A is a perspective view illustrating another embodiment of the present invention.

This embodiment employs a surface polishing method for obtaining a smoother surface as a means for processing the surfaces 12*a*, 12*b* of the thickness regulating blade 12. In this embodiment, a metal material which will easily generate burrs or flaws during mechanical processing is used for the thickness regulating blade 12. Such metal materials include SUS 301, SUS 304, SUS 631, aluminum and phosphor bronze.

In FIG. 4A, an elastic abrasive SK is formed by a rubber having a hardness of 20 kneading abrasive (diamond paste having the grain size of 1 μm). While a liquid abrasive is applied in the polishing direction, the elastic abrasive SK is reciprocally shifted in a direction parallel to the edge 12*c* of the thickness regulating blade 12. Thereby, the surfaces 12*a*, 12*b* of the thickness regulating blade 12 are polished.

Figure 4B:
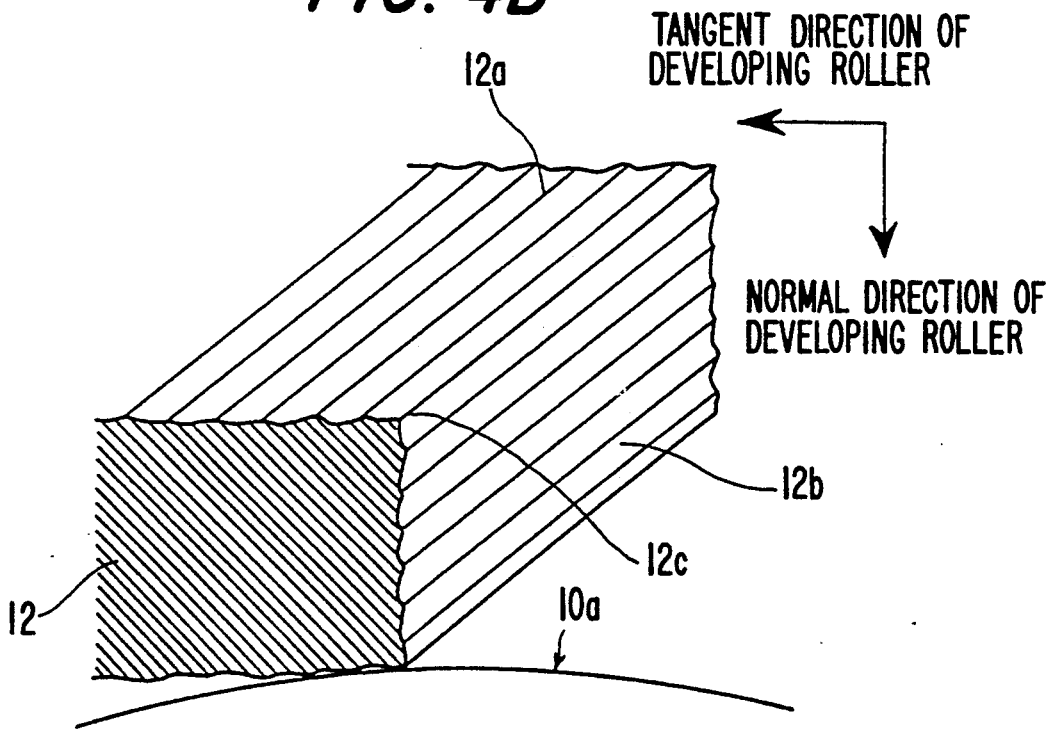
FIG. 4B is a perspective view of an enlarged portion C of the blade shown in FIG. 4A.

As a result, as shown in FIG. 4B, the surface 12*a* is reciprocally polished by the elastic abrasive SK in the direction perpendicular to the tangent direction of the developing roller 10, namely in the direction parallel to the edge 12*c*. Moreover, the surface 12*b* is polished in the direction perpendicular to the normal direction of the developing roller 10, namely in the direction parallel to the edge 12*c*.

Figure 5A:
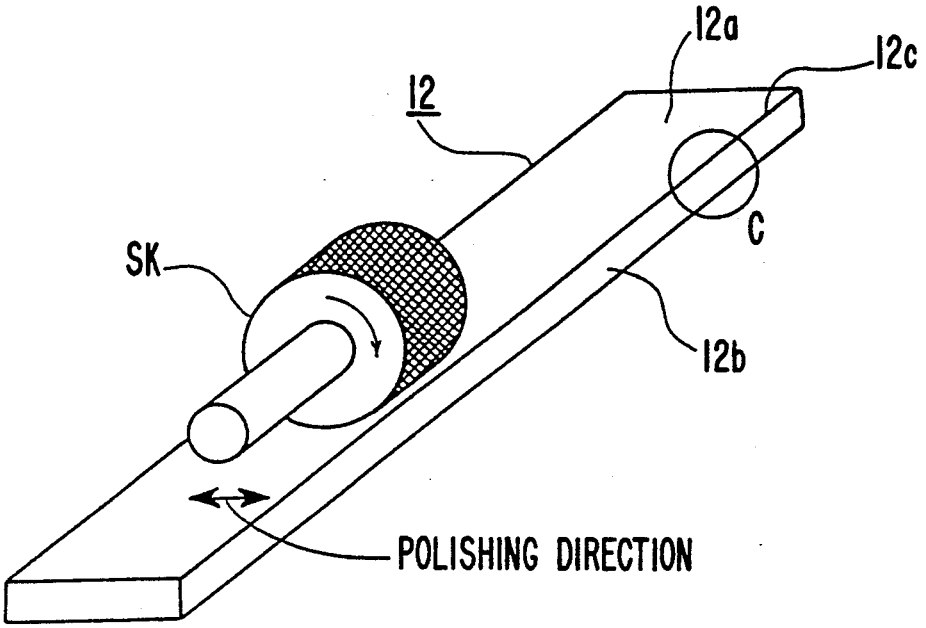
FIG. 5A is a perspective view illustrating a sample for comparison with the embodiment of the present invention shown in FIGS. 4A and 4B.
Figure 5B:
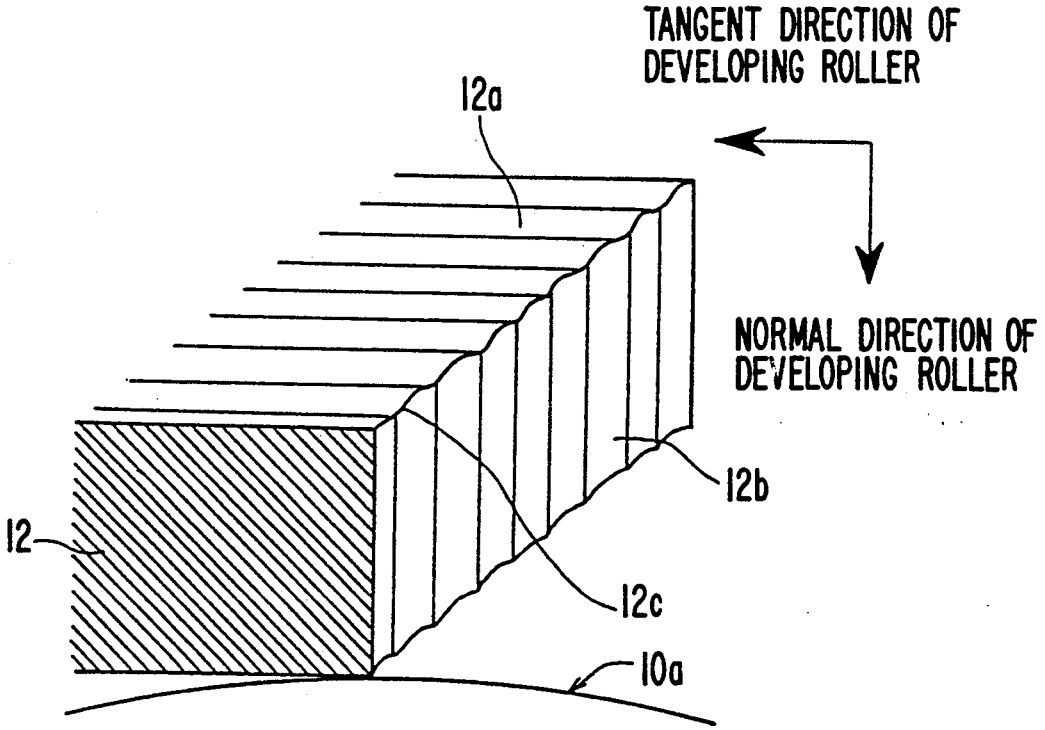
FIG. 5B is a perspective view of an enlarged portion C of the blade shown in FIG. 5A.

In order to compare the favorable results obtained by the embodiment of FIGS. 4A and 4B, another thickness regulating blade is illustrated in FIGS. 5A and 5B wherein the thickness regulating blade 12 is formed by reciprocally polishing, with the elastic abrasive SK, the surface 12*a* in the direction parallel to the tangent direction of the developing roller 10 and the surface 12*b* in the direction parallel to the normal direction of the developing roller 10.

As a test, continuous printing for printing a lateral line of one dot with an interval of one dot was conducted for 5000 recording sheets with the apparatus shown in FIG. 1, utilizing the developing apparatus provided with thickness regulating blades 12 formed according to the polishing methods shown in FIGS. 4A and 5A, respectively, wherein the polishing directions are different. This printing pattern was replaced with a pattern where many straight lines slanted by 45° in the right direction were formed together with an interval of seven dots. Generation of black lines and white lines was not observed in the initial stage regardless of which thickness regulating blade 12 was used.

In the case of a developing apparatus using the thickness regulating blade 12 as an comparative example wherein the polishing direction was set as indicated in FIG. 5A, black lines and white lines which resulted in difference of O. D of about 0.04 were generated after continuous printing for about 4000 recording sheets.

On the other hand, in the case of a developing apparatus using the thickness regulating blade 12 as another example wherein the polishing direction was set as shown in FIG. 4A, generation of white lines and black lines was not observed and excellent printing quality was attained even after continuous printing for 5000 recording sheets.

Figure 6:
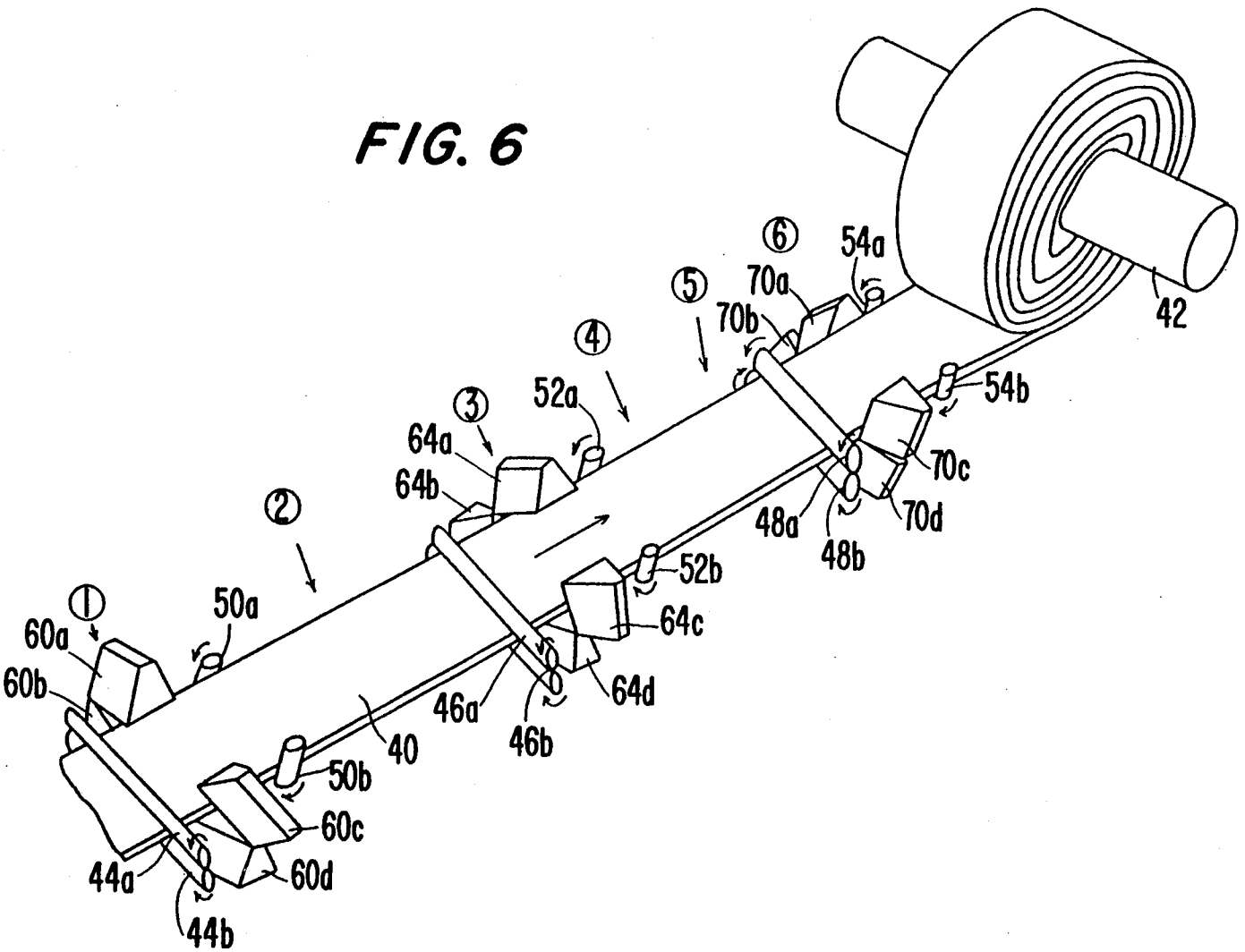
FIG. 6 is a perspective view illustrating another embodiment of the present invention.

FIG. 6 is a perspective view illustrating another embodiment of the present invention.

In FIG. 6, a steel plate 40 is supplied from a supply roll (not illustrated) formed by winding a steel plate (SUS 304) having a thickness of 0.1 mm and a width of 10 mm and the steel plate is then wound by a takeup reel 42.

Between the supply reel and takeup reel 42, three pairs of rollers 44*a*–44*b*, 46*a*–46*b*, 48*a*–48*b* prevent waving of the steel plate 40 and apply transferring forces thereto, three pairs of rollers 50*a*–50*b*, 52*a*–52*b*, 54*a*–54*b* prevent meandering running of the steel plate 40 and apply transferring force thereto and six pairs of cutter assembling bodies 1~6 which process both ends of steel plate 40 into a round shape, are provided.

Figure 7:
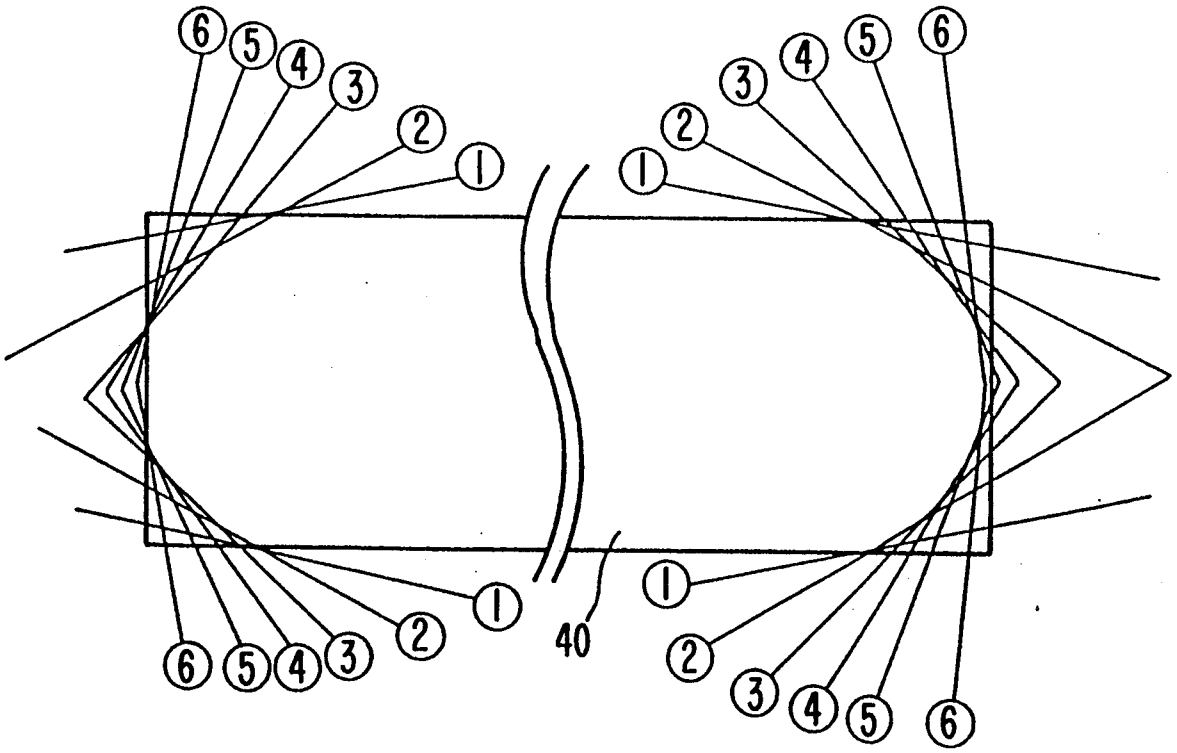
FIG. 7 is a diagram for explaining an angle of cut to process an edge of the steel plate shown in FIG. 6.

Each cutter assembling body 1~6 is respectively provided with four cutters 60*a*-60*b*-60*c*-60*d*, . . . 64*a*-64*b*-64*c*-64*d*, . . . and 70*a*-70*b*-70*c*-70*d*. As shown in FIG. 7, each cutter assembling body 1~6 is respectively set so that the angle 0 formed by the upper and lower cutters 60*a* and 60*b*; 60*c* and 60*d* is sequentially increased in the sequence of the cutter assembling bodies 1 to 6.

Therefore, while the end portion of the steel plate 40 is wound by the takeup reel 42 through each cutter assembling body 1~6 from the supply reel, it is processed in a round shape in a parallel direction to become a round edge. Thereafter, the steel plate 40 having the round edge and wound by the takeup reel is cut in the length (284 mm, in size B4) required to form a blade 12. The round edge steel plate 40 cut in the necessary length is included in the one-component developing apparatus as the thickness regulating blade 12.

Figure 8:
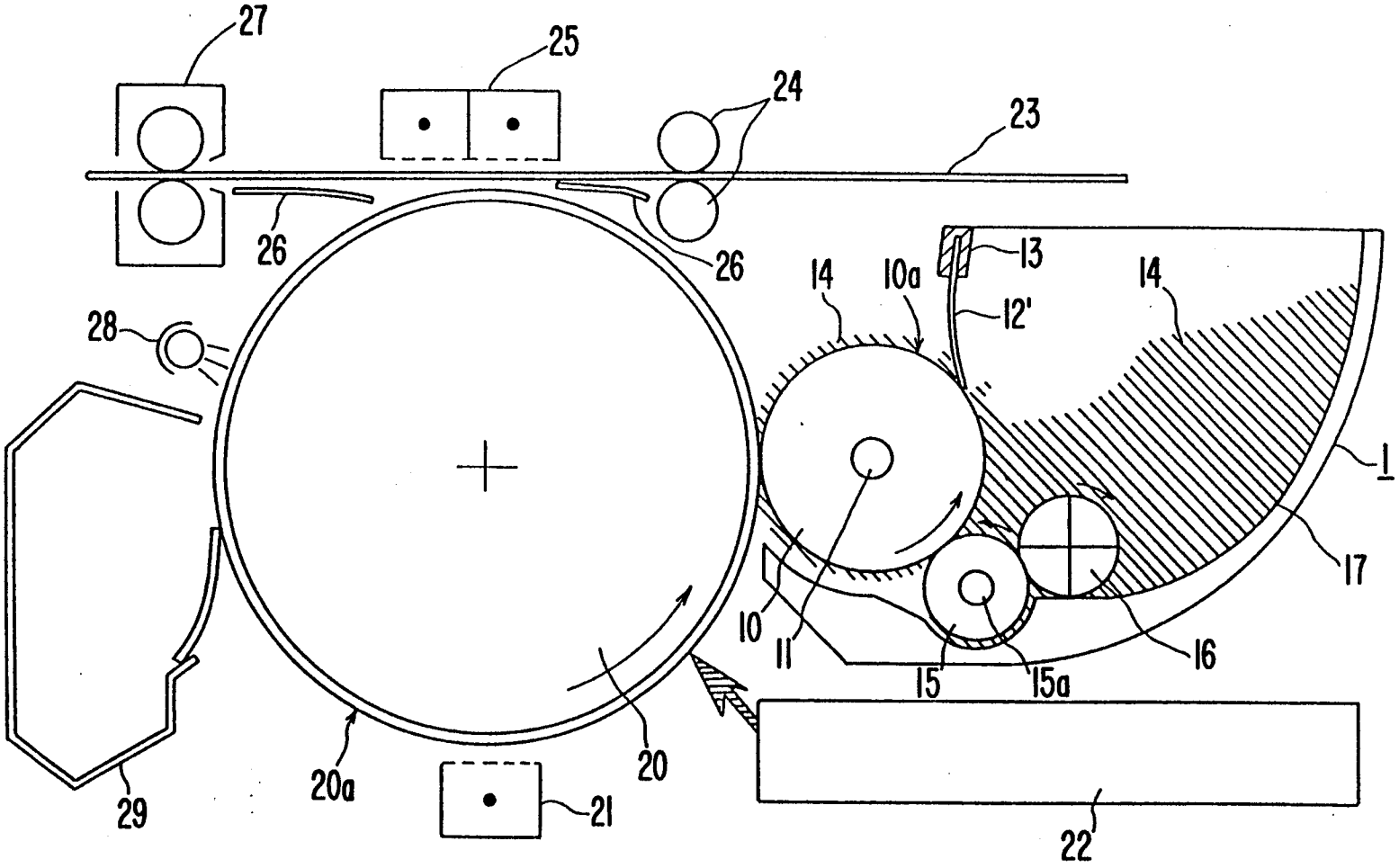
FIG. 8 is a schematic diagram of another image forming apparatus having a developing apparatus using the present invention.

FIG. 8 is a schematic diagram of another image forming apparatus having a developing apparatus using the present invention.

In FIG. 8, like numerals of FIG. 1 refer to like parts throughout. The developer layer regulating blade 12' is a round edge steel plate and is made by the method described with respect to FIGS. 6 and 7.

Figure 9B:
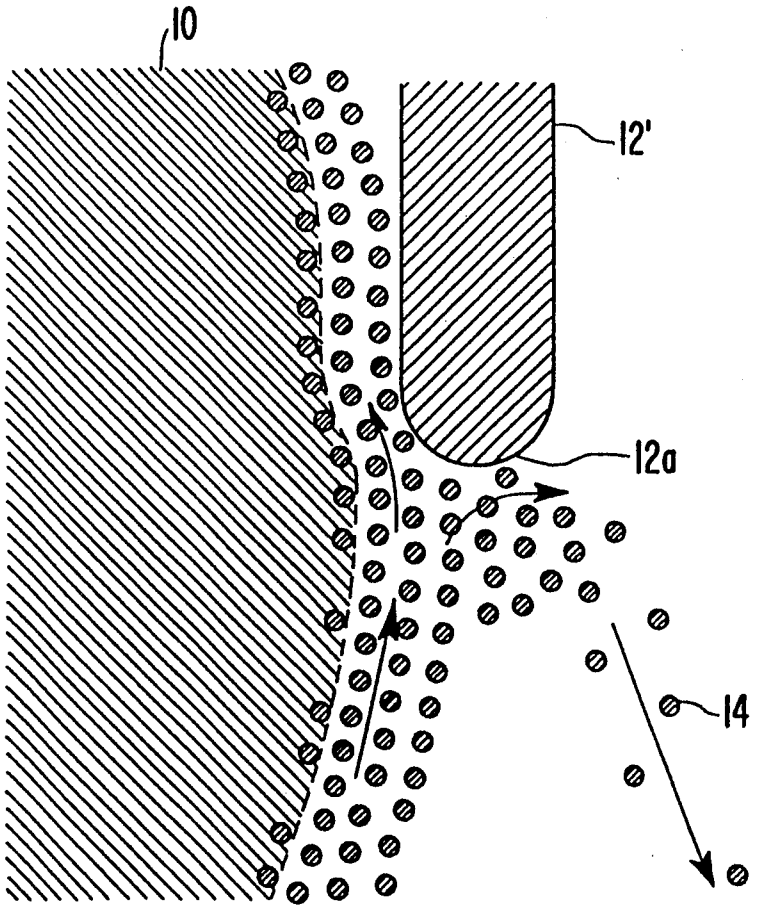
FIGS. 9A and 9B are diagrams illustrating regulation of the thickness of a developer layer by the blade shown in FIG. 8.
Figure 9A:
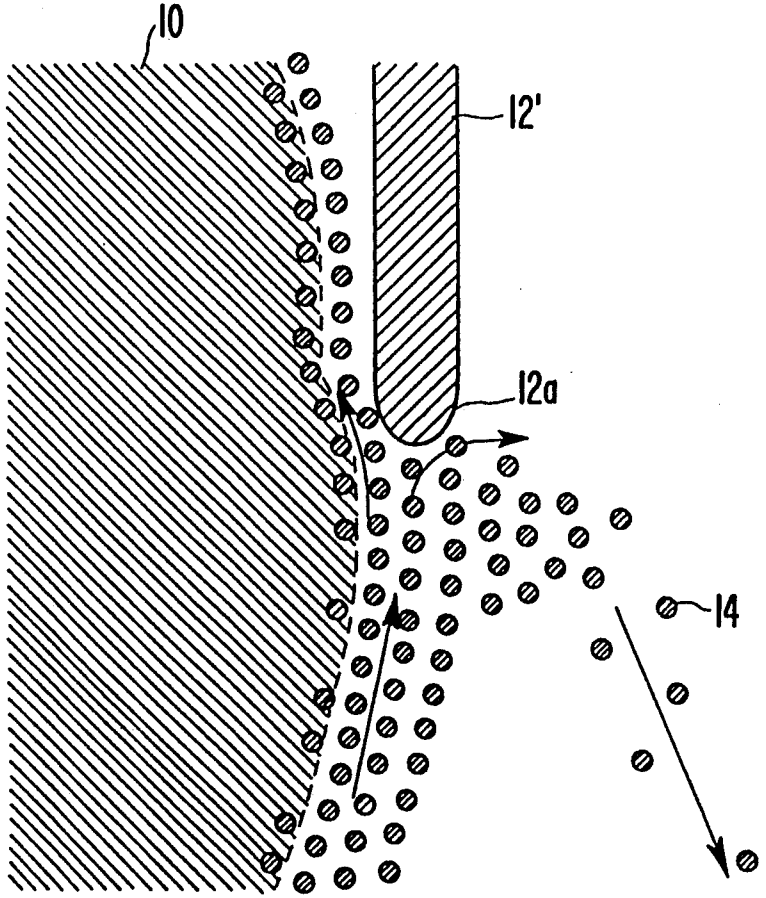

The round edge steel plate 12' has a round edge portion 12*a*, as shown in FIGS. 9A and 9B, which can be smoothly connected by eliminating the edge portion and it is used as the thickness regulating portion.

The radius of the round edge portion is determined by selecting the initial thickness of the round edge steel plate 12'. Moreover, the thickness of the developer 14 is regulated to the target thickness, as shown in FIGS. 9A and 9B, depending on the radius.

Since the round edge steel plate 12' has elasticity, it can be provided in such a manner that it is warped reversely toward the developing roller 10. Thereby, the round edge steel plate 12' also functions as a pressure applying means.

Since the round edge steel plate 12' is warped along the surface of developing roller 10 by providing it in a reversely warped condition, even when the surface of developing roller 10 includes unevenness or warpage and the developing roller 10 rotates eccentrically, the round edge portion accurately follows the surface of developing roller 10 and stable thickness regulation is realized.

A holding member 13 is provided for fixing the round edge steel plate 12'.

304 stainless steel may be used for the round edge steel plate 12'.

Moreover, a voltage of −350 V is applied to the round edge steel plate 12' in order to more stabilize the charging potential of the developer 14.

In the embodiment shown in FIG. 8, since the developer layer thickness regulating blade has a round edge portion 12*a* which forms a smooth connection, ununiformity of developer layer thickness by the edge portion is prevented.

Moreover, since the round edge steel plate 12' is provided in a reversely warped condition, the round edge steel plate 12' easily follows the unevenness and warpage of the developer bearing member 10 and thereby the material selection range of the developer bearing material 10 can be widened.

Each embodiment explained above allows the following changes or modifications.

1. A roller type developer bearing member 10 has been described but a belt type member can also be used and such a member is not limited only to those selected in the embodiments explained above.

2. A latent image bearing member 20 has been described as a photosensitive material drum, but a belt type latent image bearing member can also be used and an electrostatic recording system using a dielectric member can also be used as well as a photosensitive material.

3. The material of the developer layer thickness regulating blade 12 is not limited to only those explained in the above embodiments and the processing method is also not limited to only those explained with reference to the above embodiments.

While the present invention has been described with respect to the specific embodiments thereof, it is to be understood that the present invention is not limited to thereto in any way but covers any and all changes and modifications which will become possible within the scope of the appended claims.

What is claimed is:

1. A developing apparatus using a one-component developer to develop a latent image on an image bearing member comprising;

a developer holding member having a surface to hold the one-component developer, the surface of said developer holding member being disposed near the image bearing member in parallel with a surface of the image bearing member and supplying the one-component developer to the image bearing member to develop the latent image on the image bearing member; and a developer layer regulating member having edge means to regulate the thickness of a layer of the one-component developer on the surface of said developer holding member, said edge means being disposed in parallel with the surface of said developer holding member and further being constructed by being machined only along a direction in parallel with the surface of said developer holding member to thereby eliminate any unevenness along the length thereof and wherein said edge means has a rounded edge.

2. A developing apparatus in claim 1, wherein said developer layer regulating member is a steel plate.

3. A developing apparatus in claim 1, wherein said developer holding member is a roller.

4. A developing apparatus in claim 1, wherein the developer holding member is made of elastic material.

5. An image forming apparatus comprising:

an image bearing member;

latent image forming means for forming a latent image on said image bearing member;

developing means for developing the latent image on said image bearing member, said developing means comprising a developer holding member having a surface to hold a one-component developer, the surface of said developer holding member being disposed near said image bearing member in parallel with a surface image bearing member and supplying the one-component developer to said image bearing member to develop the latent image on said image bearing member; and a developer layer regulating member having edge means to regulate the thickness of a layer of the one-component developer on the surface of the developer holding member, said edge means being disposed in parallel with the surface of the developer holding member and further being constructed by being machined only along a direction in parallel with the surface of the developer holding member to thereby eliminate any unevenness along the length thereof said edge means having a rounded edge;

transfer means for transferring the developer to a medium from said image bearing member; and fixing means for fixing the developer to the medium.

6. An image forming apparatus in claim 5, wherein said developer layer regulating means is a steel plate.

7. An image forming apparatus in claim 5, wherein said developer holding member is a roller.

8. A developing apparatus in claim 5, wherein the developer holding member is made of elastic material.

* * * * *